US006539096B1

(12) United States Patent
Sigwanz et al.

(10) Patent No.: US 6,539,096 B1
(45) Date of Patent: Mar. 25, 2003

(54) METHOD FOR PRODUCING A VARIABLE DIRECTIONAL MICROPHONE CHARACTERISTIC AND DIGITAL HEARING AID OPERATING ACCORDING TO THE METHOD

(75) Inventors: Ullrich Sigwanz, Erlangen (DE); Fred Zoels, Altenthann (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 09/280,632

(22) Filed: Mar. 29, 1999

(30) Foreign Application Priority Data

Mar. 30, 1998 (DE) ..... 198 14 180

(51) Int. Cl.[7] ..... H04R 25/00
(52) U.S. Cl. ..... 381/313; 381/312; 381/92
(58) Field of Search ..... 381/312, 98, 111, 381/23.1, 316, 317, 318, 320, 321, 313, 91, 92, 387

(56) References Cited

U.S. PATENT DOCUMENTS 5,412,735 A * 5/1995 Engebretson et al. ..... 381/320
5,757,932 A * 5/1998 Lindemann et al. ..... 381/316
5,757,933 A * 5/1998 Preves et al. ..... 381/92
5,796,848 A 8/1998 Martin
5,917,921 A * 6/1999 Sasaki et al. ..... 381/92
6,044,162 A * 3/2000 Mead et al. ..... 381/312
6,272,229 B1 * 8/2001 Baekgaard ..... 381/313

FOREIGN PATENT DOCUMENTS

DE 40 26 420 2/1991

OTHER PUBLICATIONS

"Halbleiter–Schaltungstechnik" (1990) p. 798.

* cited by examiner

*Primary Examiner*—Curtis Kuntz
*Assistant Examiner*—Suhan Ni
(74) *Attorney, Agent, or Firm*—Schiff Hardin & Waite

(57) ABSTRACT

A digital hearing aid with a variable directional microphone characteristic, has a signal processing unit, an earphone and at least two microphones, with a sigma-delta converter as well as a delay element following immediately thereafter in at least one microphone signal path. In a method for the operation of such a digital hearing aid, an A/D conversion with the sigma-delta converter ensues in the signal path of at least one microphone and the resulting 1-bit signal is delayed.

16 Claims, 1 Drawing Sheet

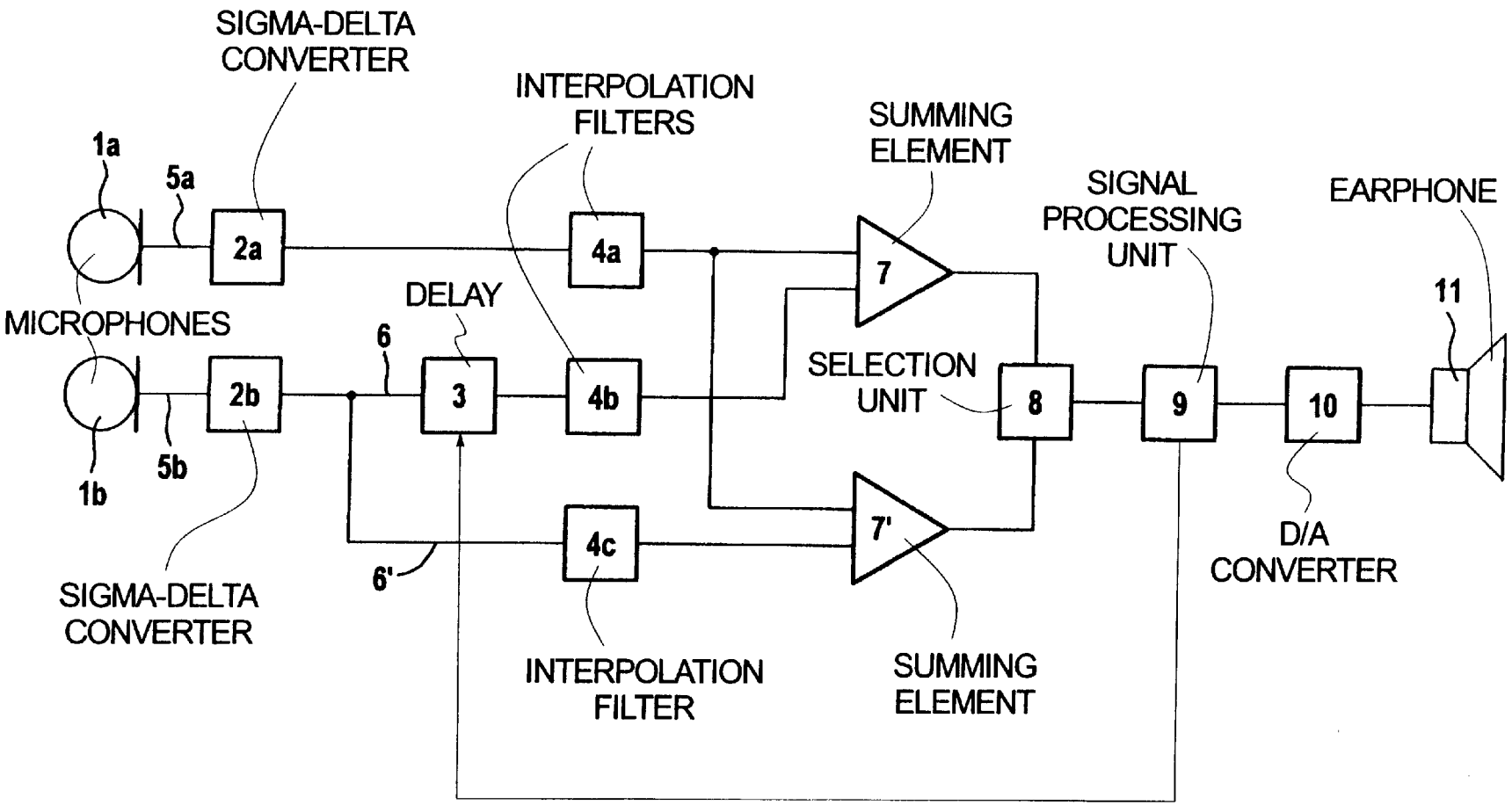
EARPHONE
11
10
D/A CONVERTER
SIGNAL PROCESSING UNIT
9
8
SELECTION UNIT
SUMMING ELEMENT
7
7'
SUMMING ELEMENT
INTERPOLATION FILTERS
4a
4b
4c
INTERPOLATION FILTER
DELAY
3
6
6'
SIGMA-DELTA CONVERTER
2a
2b
SIGMA-DELTA CONVERTER
5a
5b
1a
1b
MICROPHONES

METHOD FOR PRODUCING A VARIABLE DIRECTIONAL MICROPHONE CHARACTERISTIC AND DIGITAL HEARING AID OPERATING ACCORDING TO THE METHOD

BACKGROUND OF THE INVENTION

1. Field of the Invention

The present invention is directed to a digital hearing aid having a variable directional microphone characteristic, and to a method for operating such a digital hearing aid, of the type having a signal processing unit and earphone, and at least two microphones.

2. Description of the Prior Art

Hearing aids are known wherein the signal transit times in the individual microphone signal paths are modified mechanically or by circuitry (for example, by low-pass filters) for producing a variable directional microphone characteristic. A signal delay in the DSP (digital signal processor) stage is known for digital hearing aids. For realizing a more finely graduated adjustment of the directional microphone characteristic in digital hearing aids, however, a substantially higher sampling frequency would have to be employed and this could only be realized with considerable structural outlay and power consumption. Due to the real-time demands in the signal path, moreover, undesired falsifications of the signal to be processed would occur.

German PS 195 45 760, corresponding to U.S. Pat. No. 5,796,848, discloses a digital hearing aid with a microphone, a signal processing unit and an earphone, wherein a sigma-delta modulator as well as a following interpolation filter are provided in the microphone signal path, and wherein—for protecting against electromagnetic emission—an analog-to-digital converter is provided in the microphone housing and a digital (decade) filter and a signal processor are provided between the sigma-delta modulator and the interpolation filter.

SUMMARY OF THE INVENTION

An object of the present invention is to provide a digital hearing aid as well as a method for producing a variable directional microphone characteristic wherein a finely graduated adjustment of the directional microphone characteristic can be realized with little structural outlay.

The above object is achieved in accordance with the principles of the present invention in a digital hearing aid with a variable directional microphone characteristic having a signal processing unit, an earphone and at least two microphones each having a microphone signal path associated therewith, and wherein a sigma-delta converter immediately followed by a delay element are provided in at least one of the microphone signal paths.

The above object is also achieved in accordance with the principles of the present invention in a method for operating a digital hearing aid having a signal processing unit, an earphone and at least two microphones each having a microphone signal path associated therewith, including the step of undertaking an analog-to-digital conversion of the signal in at least one of the microphone paths using a sigma-delta converter, thereby resulting in a 1-bit output signal from the sigma-delta converter, and delaying the 1-bit output signal.

As a result of the sigma-delta converter as well as the delay element following immediately thereafter which are provided in at least one microphone signal path of the inventive hearing aid, a sampling of the microphone signal to be delayed can ensue with a sampling frequency which is significantly increased compared to known hearing aids and processing methods, allowing substantially more finely graduated delays to be achieved. An arbitrarily finely graduated transition thus can be achieved in the adjustment of the directional microphone characteristic, allowing arbitrary intermediate forms of the microphone to be realized, for example characteristics transitioning from a "Figure eight" characteristic to a "kidney-shaped" characteristic. In the inventive hearing aid, thus, a desired directional microphone characteristic can be set, individually suited to a current audio environment or a user preference.

A DSP control or a read-only memory can be allocated to the delay element.

Advantageously, an interpolation filter, preferably operating as low-pass filter, is provided in at least one microphone signal path in order to be able to attenuate signal disturbances as may occur when switching and shifting the directional microphone characteristic. As a result the transition between the individual steps of the directional microphone characteristic can be quasi-continuously designed.

In another embodiment, the inventive hearing aid has a first microphone signal path with a sigma-delta converter and an interpolation filter. Further, a second microphone signal path is provided that, following a sigma-delta converter, has a first signal path branch with a delay element and an interpolation filter and a second signal path branch arranged parallel to the first signal path branch and having a further interpolation filter.

By combining the signals of the first microphone signal path with the signals of the first or second signal path branches, different directional microphone characteristics can be achieved in respective summing elements, since a different directional microphone characteristic arises in each of the summing elements due to the delay in the first signal path branch.

The two directional microphone characteristics can be compared and, if necessary, processed by the addition of further parameters (for example, comparison to stored patterns of directional microphone characteristics) in order to select the directional microphone characteristic to be ultimately set.

The analysis and selection of the suitable directional microphone characteristic from among a number of available directional microphone characteristics can ensue with a selection unit, which can be programmable and may employ fuzzy logic or a neural network.

As a result, for example, acquired, different directional microphone characteristics can be compared to stored pattern characteristics, so that a user-friendly selection of the suitable directional microphone characteristic can ensue using decision rules.

The inventive hearing aid can include further signal path branches that are equipped with or without delay elements in order to be combined in respective summing elements and produce a number of directional microphone characteristics, from which the suitable directional microphone characteristic can then be selected. As warranted, a selected directional microphone characteristic can be adapted again by stored correction values, or mixtures of two or more directional microphone characteristics can also be realized.

In the inventive method, an A/D conversion is implemented in the signal path of at least one microphone by a sigma-delta converter, and the resulting 1-bit signal is delayed. As a result of the small word width of the output signal of the sigma-delta converter (1 bit) compared to the word width in the DSP unit (for example, 16 bits), considerably higher sampling rates can be used in the signal delay, so that a correspondingly more finely graduated delay can be realized. In the inventive method, the delay can ensue using a DSP control or with a shift register. If the signal in the signal path of at least one microphone passes through an interpolation filter, preferably operating as a low-pass filter, signal disturbances as may occur when switching between different delay rates can be attenuated or avoided.

The inventive method makes it possible to sample the signal to be delayed with a higher sampling rate, whereby sampling frequencies of far above 20 kHz can be achieved. The respective sampling frequency or the frequency range for matching to the specific requirements of the signal processing can be identified by trials. The inventive method is preferably implemented with elevated sampling frequencies of 400–800 kHz. Compared to a low-frequency sampling of, for example, 20 kHz wherein the samples can be shifted by 50 $\mu$s, correspondingly more finely graduated shifts of 1.25 $\mu$s–2.5 $\mu$s are achieved by the elevated sampling rates of 400–800 kHz.

In further versions of the method, delayed and undelayed signal forwarding can occur in parallel branches in at least one microphone signal path, so that corresponding directional microphone characteristics that can be compared to one another are achieved by combining corresponding delayed and undelayed branch signals in summing elements.

Using, to the extent necessary stored decision rules or pattern characteristics, a suitable directional microphone characteristic can then be selected from a number of directional microphone characteristics or can be achieved by superimposition and adaptation of existing directional microphone characteristics.

DESCRIPTION OF THE DRAWING

The single FIGURE is a block circuit diagram of a digital hearing aid constructed and operating in accordance with the principles of the present invention.

DESCRIPTION OF THE PREFERRED EMBODIMENTS

The FIGURE shows a hearing aid with a first microphone 1*a* having a first microphone signal path 5*a* in which a sigma-delta converter 2*a* is arranged. The 1-bit output signal thereof passes through an interpolation filter 4*a* and is then supplied to summing elements 7 and 7'.

In a second microphone signal path 5*b* of the microphone 1*b*, the output signal of the sigma-delta converter 2*b* is delayed in a first signal path branch 6 by a delay element 3 and the delayed signal is supplied to the summing element 7 after passing through the interpolation filter 4*b*.

In the second signal path branch 6' of the second microphone signal path 5*b*, the output signal of the sigma-delta converter 2*b* is supplied undelayed to the summing element 7 via the interpolation filter 4*c*. Different directional microphone characteristics are thus present at the respective outputs of the summing elements 7 and 7'. For example, a "kidney-shaped" characteristic can be present at the output of the summing element 7 due to the delay by the delay element 3 in the signal path branch 6.

A "Figure eight" characteristic can be present at the output of the summing element 7' since the input signals of the summing element 7' from the first microphone signal path 5*a* and the second signal path branch 6' are both undelayed.

The directional microphone characteristics of the summing elements 7 and 7' are compared and analyzed in a selection unit 8. One of the two characteristics of the respective summing elements 7 and 7' is subsequently selected possibly using further parameters (for example, other information about the useful/unwanted sound situation, stored model characteristics, etc.). Further, the "raw" output characteristics of the respective summing elements 7 and 7' can be modified, and/or adapted and/or superimposed.

The ultimately determined directional microphone characteristic, an output signal of the selection unit 8, is supplied to an earphone 11 via a signal processing unit 9 and a D/A converter 10. In addition to the version of the circuit shown in the FIGURE, wherein two parallel signal path branches 6 and 6' are situated in the second microphone signal path 5*b*, further signal path branches with or without delay elements also can be provided in one or more of the microphone signal paths (not shown).

As a result, an arbitrary versatility of calculated directional microphone characteristics can be achieved in order to set a suitable, correspondingly finely adapted directional microphone characteristic in following selection and decision units.

As shown in the FIGURE a control line can proceed from the signal processing unit 9 to the delay element 3 to adjust the delay of the delay element 3.

Although modifications and changes may be suggested by those skilled in the art, it is the intention of the inventors to embody within the patent warranted hereon all changes and modifications as reasonably and properly come within the scope of their contribution to the art.

We claim as our invention:

1. A digital hearing aid with a variable directional microphone characteristic comprising:

a plurality of microphones for picking up incoming audio signals and respectively producing at least two analog microphone output signals;

a plurality of microphone signal paths respectively connected to said plurality of microphones, supplied with the respective analog microphone output signals from said plurality of microphones;

at least one of said plurality of microphone signal paths having a sigma-delta converter, which produces a one-bit digital output signal from the analog microphone output signal therein, immediately followed by a delay element;

circuitry connected to said plurality of microphone signal paths for obtaining a signal having a directional microphone characteristic, representing a direction from which said incoming audio signals originate, from said signals respectively in said plurality of microphone signal paths;

a digital signal processor supplied with said signal having said directional signal characteristic, for sampling said signal having said directional microphone characteristic, for producing a processed signal having said directional microphone characteristic therefrom; and an earphone connected to said signal processor for converting said processed signal into an audio signal having said directional microphone characteristic and for emitting said audio signal having said directional microphone characteristic.

2. A digital hearing aid as claimed in claim 1 wherein said digital signal processor produces a control signal supplied to said delay element for adjusting a delay of said delay element.

3. A digital hearing aid as claimed in claim 1 wherein said delay element comprises a shift register.

4. A digital hearing aid as claimed in claim 1 further comprising an interpolation filter connected in at least of one said plurality of microphone signal paths.

5. A digital hearing aid as claimed in claim 4 wherein said interpolation filter comprises a low pass filter.

6. A hearing aid as claimed in claim 1 wherein said sigma-delta converter comprises a first sigma-delta converter, and wherein a first of said plurality of microphone signal paths comprises a second sigma-delta converter followed by an interpolation filter, and produces a first output, and wherein a second of said plurality of microphone signal paths comprises said first sigma-delta converter and has a first signal path branch containing said delay element, and an interpolation filter, and produces a second signal, and has a second signal path branch, in parallel with said first signal path branch, containing a further interpolation filter, and which produces a third signal, and wherein said circuitry includes a first summing unit supplied with said first and second signals and a second summing unit supplied with said first and third signals, each of said summing units producing an output and a selection unit to which the respective outputs of said summing units are supplied for selectively combining the respective outputs of said summing units to produce said signal having a directional microphone characteristic.

7. A method for operating a digital hearing aid to produce a variable directional microphone characteristic, comprising the steps of:

providing a plurality of microphones and a plurality microphone signal paths associated therewith, a digital signal processor and an earphone;

picking up incoming audio signals with said plurality of microphones and thereby producing respective analog microphone output signals in said microphone signal paths;

in at least one of said microphone signal paths, converting the analog microphone output signal therein into a digital signal using a sigma-delta converter, to obtain a 1-bit output signal and delaying said 1-bit output signal to produce a delayed signal;

from said respective microphone output signals, including said delayed signal, obtaining a signal having a directional microphone characteristic, representing a direction from which said incoming audio signals originate;

supplying said signal having said directional microphone characteristic to said digital signal processor and digitally processing said signal to produce a processed signal having said directional microphone characteristic by sampling said signal having said directional microphone characteristic; and supplying said processed signal having said directional characteristic to said earphone and from said earphone emitting an audio signal having said directional microphone characteristic.

8. A method as claimed in claim 7 wherein said signal processing unit comprises a digital signal processing unit wherein said method comprises producing a digital signal in said digital signal processor and using said digital control signal to adjust the delay of said 1-bit output signal.

9. A method as claimed in claim 7 wherein the step of delaying said 1-bit output signal comprises delaying said 1-bit output signal in a shift register.

10. A method as claimed in claim 7 comprising the additional step of filtering the signal in said at least one microphone signal path in an interpolation filter.

11. A method as claimed in claim 10 comprising low-pass filtering said signal in said interpolation filter.

12. A method as claimed in claim 7 comprising the additional step of sampling said signal in said one of said microphone paths with a sampling frequency that exceeds 20 kHz.

13. A method as claimed in claim 12 wherein the step of sampling comprises sampling said signal in said one of said microphone paths with a sampling frequency in a range between 400 kHz and 800 kHz.

14. A method as claimed in claim 7 further comprising providing a first branch in said one of said microphone signal paths and delaying said signal in said first branch, and providing a second branch in said one of said microphone signal paths in parallel with said first branch and conducting said signal undelayed through said second branch.

15. A method as claimed in claim 7 wherein the step of delaying said signal comprises delaying said signal with a plurality of different delays in parallel in respectively different branches in said one of said microphone signal paths.

16. A method as claimed in claim 15 wherein the step of obtaining a signal having a directional characteristic comprises combining respective signals from said plurality of different branches to obtain a plurality of different directional microphone characteristics, and selecting one of said plurality of directional microphone characteristics for supply to said signal processor.

* * * * *